US006191675B1

(12) United States Patent
Sudo et al.

(10) Patent No.: US 6,191,675 B1
(45) Date of Patent: Feb. 20, 2001

(54) HIGH VOLTAGE TRANSFORMER AND IGNITION TRANSFORMER USING THE SAME

(75) Inventors: Ryoichi Sudo, Yokosuka; Tetsuo Tajima, Fujisawa; Kazutoshi Kobayashi, Hitachinaka; Makoto Iida, Kawasaki, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/294,323

(22) Filed: Apr. 20, 1999

(30) Foreign Application Priority Data

Apr. 22, 1998 (JP) ..... 10-112005

(51) Int. Cl.[7] ..... H01F 27/02
(52) U.S. Cl. ..... 336/96; 336/198
(58) Field of Search ..... 336/96, 198, 90; 123/634, 635

(56) References Cited

U.S. PATENT DOCUMENTS 5,381,089 * 1/1995 Dickmeyer et al. ..... 324/174
5,629,661 * 5/1997 Ooi et al. ..... 336/198
5,632,259 * 5/1997 Konda et al. ..... 123/634
5,872,163 * 2/1999 Hollstein et al. ..... 523/216

* cited by examiner

*Primary Examiner*—Michael L. Gellner
*Assistant Examiner*—Tuyen Nguyen
(74) *Attorney, Agent, or Firm*—Antonelli, Terry, Stout & Kraus, LLP

(57) ABSTRACT

A small-sized heat resisting high voltage transformer and an ignition transformer using the high voltage transformer are provided and utilize both a heat resistant casting resin and a bobbin, which contain an inorganic filler. The high voltage transformer is capable of producing an output voltage of 10–35 kV and comprises a primary coil, a secondary coil, and a magnetic core, wherein a casting resin is injected into the coil part and subsequently cured. The casting resin and bobbin material used for making the coils have heat distortion temperature of at least 130° C., and contain an inorganic filler. The surface of the bobbin may be pretreated. Thereby, adhesion between a bobbin and a casting resin is enhanced to ensure operating properly under the sever heat cycle condition and provide a small-sized heat resistant high voltage transformer.

30 Claims, 3 Drawing Sheets

HIGH VOLTAGE TRANSFORMER AND IGNITION TRANSFORMER USING THE SAME

BACKGROUND OF THE INVENTION

1. Field of the Invention

This invention relates to a small sized high voltage transformer comprising a primary coil, a secondary coil, and a magnetic core, and to an ignition transformer using the high voltage transformer.

2. Description of the Related Art

Transformers used in automobiles for ignition, and flyback transformers for driving cathode ray tubes are required to generate a high pulse voltage output of 10 kV to 35 kV. These transformers have firstly been assembled from a primary coil, a secondary coil and a magnetic core, and then a casting resin is injected into the coil part, and subsequently cured to complete the constitution of a transformer. In this type of transformers a high voltage is produced in the secondary coil by raising a special pulse voltage fed into the primary coil.

Described below is a detailed example of known manufacturing method for an ignition transformer of direct ignition type used for automobiles as illustrated in FIG. 1. A secondary coil 3 wound on a secondary bobbin 2 is arranged around an inner magnetic core 1-1. After a primary coil 5 wound on a primary bobbin 4 is arranged and an inner magnetic core 1-2 is attached to the both ends of the coil, the parts are housed in a case 6. A casting resin 7 is poured into the case 6 to fill the clearance in a transformer 8 and the void in coil 9, and subsequently heat cured. Putting an exterior magnetic core 1-3 around the case completes the constitution of the transformer.

An example of conventional method widely used for manufacturing a flyback transformer for driving cathode ray tubes as shown in FIG. 2 is also described below. A secondary coil 3 wound on an intermediate layer 10 coated on the secondary bobbin 2 is arranged around a primary coil 5 wound on a primary bobbin 4. The parts are housed in a case 6. A casting resin 7 is injected into the case 6 to fill the clearance in the transformer 8 and the narrow void in coil 9, and then heat cured. Fitting of the magnetic core 1 completes the constitution of the transformer.

These transformers are required to function properly for a long period of use life under a high temperature in a cramped space in the transformer. Therefore, long term durability under heat and moisture has been a very important requirement. In the manufacture of such high voltage transformers, choice of combination of the casting resin and the material used for the bobbin is very important. The reason is that the lack of adhesion between the two materials may cause separation of the two materials. Difference in heat expansion coefficients between the two materials may case thermal stress, resulting in cracking in the casted resin. Thereby the dielectric breakdown in the coil may occur due to the electric discharge. In addition, withstanding voltage properties of the bobbin material and the casting resin are also required.

To avoid dielectric breakdown, attempts have been made to select a combination of a casting resin and a bobbin material which will give good adhesion between the two materials. For this reason, epoxy resins having a heat distortion temperature ranging from 90° C. to 120° C. have been widely used as the casting resins in combination with a bobbin material such as a blend of polyphenylene oxide and polystyrene (ex. Noryl, Trademark of GE Company) having heat distortion temperature of approximately 120° C. The reason why the above combination has been selected lies in the belief that surface of Noryl resin partially swells when contacted with a liquid epoxy resin thereby providing a good adhesion layer as the epoxy resin undergoes curing.

However, heat distortion temperatures of epoxy resins and bobbin materials conventionally used are not high enough. Therefore, these materials tend to soften when transformers are subjected to a temperature higher than 120° C. This has been a cause of mechanical deformation and dielectric breakdown of the materials employed in transformers.

In the conventional distributor system, one transformer is connected to multiple number of engines. On the other hand, recently, in order to improve power controllability of automobiles, a direct ignition system has been adopted, wherein plural transformers are connected directly to the same number of engines.

As a flyback transformer for driving cathode ray tubes, weight reductions of display is becoming major requirement in the market as well as the requirement for cost reduction. In these types of transformers, reduction in weight, size and cost of transformers are important issues.

However, in the conventional transformer, since the combination of materials were limited, and could not satisfy the severe requirement for use and its size reduction. When an epoxy resin of higher heat distortion temperature is used to improve heat resistance in combination with a conventional bobbin material, matching of heat expansion coefficients of the two materials becomes a problem resulting in poor adhesion between the two materials.

SUMMARY OF THE INVENTION

An object of the invention is to provide a small-sized heat resistant high voltage transformer and an ignition transformer by solving the problems.

Another object of the invention is to provide a heat resistant high voltage transformer which is capable of producing output voltage of 15–35 kV , using a casting resin and a coil bobbin both having a heat distortion temperature of 130° C. or above.

The heat distortion temperature herein referred is the temperature at which deformation of a casting resin composition or a molded bobbin starts to occur when exposed to that temperature. Generally, these values can be replaced with the values obtained at the loading of 1.82 MP a according to ASTM D648.

As for casting resins, epoxy resins containing 30–55 wt % of inorganic filler may be used.

The inorganic fillers used in the casting resins are silica, silica glass or a mixture of silica and silica glass. Alumina, hydrated alumina, calcium carbonate and other type of inorganic fillers may be added to modify the characteristics of the fillers as required.

Inorganic fillers contained in the mold composition of coil bobbins may be glass fiber, talc, or a mixture of glass fiber and talc, and can be modified by adding glass beads, mica, silica, alumina, calcium carbonate, or other inorganic fillers as required.

The coil bobbins are made from mold compositions containing 25–70 wt. % of an inorganic filler and a resin such as, polyphenylene sulfide, polyether sulfone, polyether imide, polyether ketone, and liquid crystal polymer. When an epoxy resin is precoated on the bobbin which swells with a solvent, 10–70 wt. % of an inorganic filler may be incorporated.

Pretreatments on the surface of coil bobbins, such as sandblast treatment and precoating with a solid epoxy resin are found to be very effective.

In order to maintain the heat distortion temperature of the casting resin at a temperature of at least 130° C., bis-phenol A di-glycidyl ether or bis-phenol F di-glycidyl ether can be used as a main ingredient for the epoxy resin. Addition of alicyclic epoxy compounds is particularly effective in keeping high heat distortion temperature. Alicyclic epoxy compounds are relatively low in viscosity before curing and are effective in raising heat distortion temperature of epoxy curing compositions. Examples of suitable alicyclic epoxy compositions are cyclohexene oxide, 3,4-epoxycyclohexylmethyl-3,4-epoxycyclohexanecarboxylate, and etc.

Useful as curing agents for epoxy resins are methyl-tetrahydrophthalic anhydride, methyl-hexahydrophthalic anhydride, and hexahydrophthalic anhydride. Particularly useful in raising heat distortion temperature are methyl-hexahydrophthalic anhydride and hexahydrophthalic anhydride.

Imidazoles are found to be useful as catalysts for curing epoxy resins. Particularly effective are 2-ethyl-4-methyimidazole, its adduct with acrylonitrile, and 1-methyl-2-ethylimidazole.

A wide variety of inorganic fillers may be used for casting resins. Considering electric insulation performance, low heat expansion coefficient and cost, silica, silica glass, or a mixture of silica and silica glass may be preferred. In using these fillers, heat expansion coefficient can be maintained at a value close to the value of the coil bobbin without impairing electric insulation performance of the casting resin used.

The amount of inorganic filler added to the casting resins may range from 30–55 wt. %, preferably 35–50 wt. %. If the amount used is less than 30 wt. % the difference in heat expansion coefficients between the casting resin and the bobbin material increases and causes cracking in the cured casting resin. If the amount exceeds 55 wt. %, the casting resin becomes too viscous to be injected smoothly into the transformer.

As for coil bobbin materials, heat resistant, injection moldable polymeric materials having heat distortion temperature of at least 130° C. may be preferred. Examples of such polymeric materials are polyphenylene sulfide, polyether sufone, polyether imide, polyether ketone, and liquid crystal aromatic polyester (widely known as "liquid crystal polymer").

However, when the material mentioned above is used with an epoxy resin it may cause dielectric breakdown at the startup of the transformer. Poor compatibility of the casting resin with the bobbin material and the presence of a mold release agent deposited on the surface of the molded bobbin may cause poor adhesion between the bobbin and the injected resin resulting in separation of the two materials. This separation may trigger cracking in the cured casting resin and cause dielectric breakdown at the startup of the transformer.

In the actual running test of a transformer it was found that incorporation of an inorganic filler in the amount of 25–70 wt. % in the coil bobbin was quite effective in overcoming the problem mentioned above. More preferably, incorporation of the inorganic filler in the amount of 45–65 wt. % was found to be more effective. If the content of the filler is less than 25 wt. % lack of adhesion may occur between the injected resin and the bobbin material resulting in separation between the two materials and/or cracking of the injected resin in the transformer. If the content of the filler exceeds 70 wt. %, moldability of the bobbin becomes a problem.

There are various inorganic fillers available for the ingredient to be incorporated in the coil bobbin. However, in view of requirements such as good electric insulation performance, low heat expansion coefficient, good wear resistance of mold, and low cost, it is desirable to use, as a main component, glass fiber, talc, or a mixture of glass fiber and talc.

It is effective to use inorganic filler as much as possible as long as the fluidity of the molding mixture remains satisfactory during molding. The inorganic filler in the coil bobbin comes out to the surface and prevents the surface from being covered by the mold release agent contained in the molding compound. Furthermore, the filler itself can adhere to the epoxy resin to enhance adhesion between the bobbin and casting resin.

Among heat resistant polymeric materials, polyphenylene sulfide, polyether sulfone, polyether imide, and liquid crystalline aromatic polyester have excellent fluidity during molding, allowing addition of a relatively large quantity of inorganic filler in the molding formulation to provide high level of adhesion with the epoxy resin. Polyphenylene sulfide is particularly excellent in fluidity.

Although the method described above adequately provide a high voltage transformer, further improvements in guaranteeing reliability and extending use life can be achieved by various means of pretreatments of the bobbin surface.

Among the surface treatments on the bobbin, sandblast treatment and coating of a solid epoxy resin are effective.

Sandblast treatment used in this method involves blowing of compressed air with a powder against the surface of the molded bobbin thereby the surface of the bobbin is thinly removed. Mold release agent and dirt remained on the molded surface are removed by this treatment to improve adhesion. This treatment also gives roughness on the surface, which will give additional improvement in adhesion. The pressure of the compressed air is preferably in the range of 0.1–0.9 Mpa, and more preferably in the range of 0.2–0.5 Mpa.

The powders suitable for the sandblasting mentioned above are alumina, silica, silicone carbide, glass, and hard resins such as nylon. Preferred particle size of the powder ranges from 0.04 to 1 mm, and more preferably from 0.1 to 0.5 mm. Surface coating with the epoxy resin as described above is achieved in the following manner. A solid epoxy resin at room temperature is dissolved into a solvent to give a coating solution. After a coil bobbin is immersed into the solution, the coil bobbin is removed from the solution and dried. Although any epoxy resin may be used for this purpose, one of the examples is prepared by using an oligomer made by condensation reaction of bis-phenol A and epichlorohydrin. The epoxy resin thus obtained has epoxy equivalent of 450–5000, and softening point of 64–144° C. A more preferred resin has epoxy equivalent of 800–2200 and softening point of 93–128° C.

Although any solvent which can dissolve the subject epoxy resin can be used for this purpose, solubility, workability and safety needs to be considered in selecting the most suitable solvent. Taking these factors into consideration, solvents suitable for this purpose are butyl acetate, acetone, methylethylketone, ethyleneglycol monoethylether, toluene, N-methylpyrolidone, dimethylformamide, and dimethylacetoamide. A preferred epoxy resin concentration is 1–20 wt. %.

Coating the surface of bobbins with the epoxy resin can increase adhesion of the bobbins to molding resins by the following reasons. It removes the release agent remained on the surface by dissolving it. It also increases the compatibility of the bobbin surface with the epoxy because the surface of bobbin is partially dissolved by the solvent used in epoxy coating solution. In addition it is expected that the coated epoxy resin can undergo curing reaction with the casting resin to increase adhesion between the bobbin and casting resin.

Among the heat resistant polymers used for the bobbin material in this invention, polyether sulfone and polyether imide are non-crystalline and easy to swell in organic solvents. Particularly, they dissolve gradually into solvents, such as, N-methyl pyrrolidone, dimethyl formamide and dimethyl acetoamide. The coating solution that contains such solvent significantly increases compatibility of the epoxy resin with the bobbin surface. Therefore, when polyether sulfone or polyether imide is used for the bobbin material, good adhesion between the bobbin and epoxy can be achieved so long as the content of the inorganic filler is within the range of 10–70 wt. %.

In order to clean the surface of the bobbin, conventional method such as, oxygen plasma treatment, ultraviolet ozone treatment, or corona discharge treatment can be used together with treatments such as sandblast and epoxy coating treatments described in this invention.

Oxygen plasma treatment is made in the following steps. First, the subject bobbin is placed in a treatment chamber. After the chamber is subject to a reduced pressure, plasma is generated while small amount of oxygen is introduced. This treatment can remove any mold release agent and dirt remained on the surface of the bobbin.

Ultraviolet ozone treatment is done by irradiating UV light having wavelength of approximately 200 nm onto the bobbin in the presence of air. Ozone thus generated removes dirt on the surface while the surface of the bobbin is activated by ultraviolet light.

In corona discharge treatment applying high voltage between the subject bobbin and the counter electrode generates corona discharge. Energy generated by corona discharge can remove dirt on the surface of the molded bobbin.

BRIEF DESCRIPTION OF THE DRAWING

Preferred embodiments of the invention will be described in detail as follows.

DETAILED DESCRIPTION OF PREFERRED EMBODIMENTS

EXAMPLE 1

A liquid epoxy molding resin composition may be prepared by formulating an epoxy resin component, a curing agent, a catalyst and an inorganic filler. The epoxy resin component may be made using bis-phenol A diglycidyl ether, bis-phenol F diglycidyl ether, and aliphatic epoxy compound as its main component. As the curing agent, a mixture of methyl tetrahydrophthalic anhydride and methyl hexahydrophthalic anhydride may be used with an imidazole as a catalyst. By varying the amount of each components mentioned above, various compositions of different heat distortion temperatures can be obtained.

Figure 1:
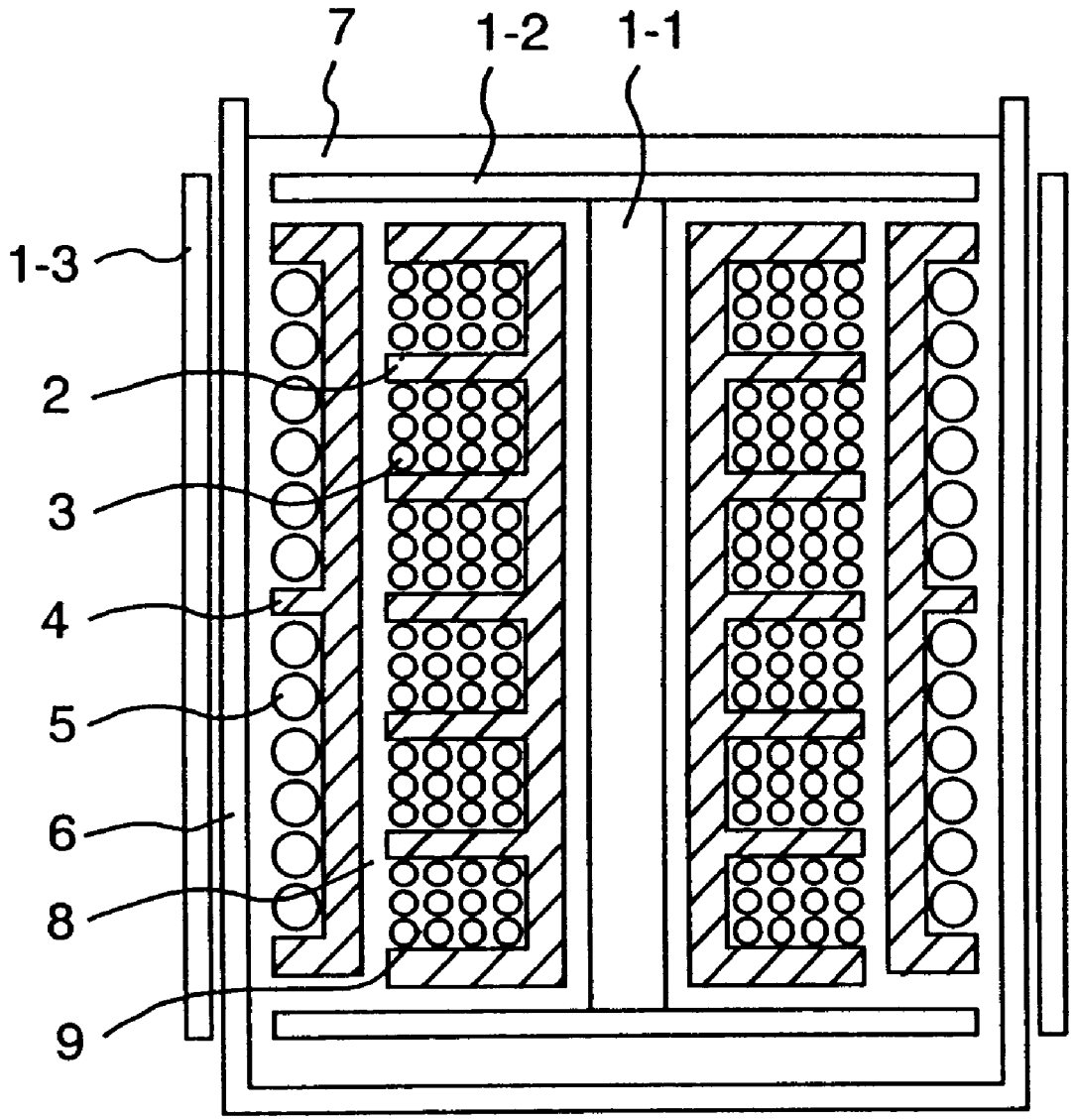
FIG. 1 is a schematic illustration of an automotive ignition transformer.

As a high voltage transformer, an automotive ignition transformer of direct ignition type having a structure as illustrated in FIG. 1 was used to test the molding resin compositions described above. This transformer is 22 mm in diameter and 100 mm in length having a primary coil being 19 mm in diameter and 90 mm in length, and a secondary coil being 15 mm in diameter and 90 mm in length. A primary and secondary bobbins were prepared by molding various molding compositions, and then, primary and secondary coils were wound on the corresponding bobbins.

After the interior magnetic core 1-1, 1-2, the secondary bobbin 2, the coil 3, the primary bobbin 4, the coil 5, and the case 6 were assembled together, the entire unit was heated to dry at 115° C. in an oven to remove moisture. Under the vacuum, an epoxy molding resin 7 was injected into the unit.

Curing of the molding resins were made by raising temperature starting from room temperature. The final curing conditions were carefully controlled.

Fitting the exterior core 1-3 around the case 6, which contains epoxy curing compound, completed the constitution of the ignition transformer.

The initial condition of the transformer was detremined by checking the appearance and rated operation. Furthermore, the transformer was subjected to heat cycle test, one cycle being −40° C. for 1 hour and 130° C. for 1 hour. The transformer was tested after each cycle, and checked to see if any dielectric breakdown occurred. At the time point where dielectric breakdown was observed is set equal to the life of the transformer. The result of the experiment run on the samples prepared as described above is summarized in the Table 1–5.

The Table 1 summarizes the result of this experiments showing the performance of transformers against varying samples of molding resins and bobbins.

In Table 1 the Comparative Example Data No. 1 shows the level of performance of conventional transformers seen in the prior art. As for the bobbin material, a mixture of polyphenylene oxide and polystyrene) (for example, PPO composition, Noryl which is a commercial name of a product from GE Corporation) having a heat distortion temperature of approximately 130° C., ASTM D 648 (loading applied: 1.82 MP a) has been widely used When this material was used for testing, deformation started to occur at 120° C. Therefore, the final curing condition for this material was set to 115° C./3 h.

The initial performance of the transformer in the Comparative Example Data No.1 was satisfactory. However, even after one heat cycle, deformation of the molding resin and bobbin occurred, and dielectric breakdown was observed. To overcome this problem heat distortion temperature of the molding resin was raised as seen in Comparative Example Data No. 2 and No. 3. However, in both cases deformation of the bobbin occurred during the curing stage.

In Comparative Example Data No. 4 and No. 5, the transformer was made using molding resins having heat distortion temperature of 150° C. and bobbins made of polyphenylene oxide (PPS) with inorganic fillers having heat distortion temperature of 270° C.

In Comparative Example Data No. 4 the content of the inorganic filler in the molding resin was insufficient being less than 10 wt. % thus causing the molded resin to crack.

In Comparative Example Data No. 5 the initial performance of the transformer was satisfactory. However, heat cycle life was only 50 cycles, far short of the first target of 300 cycles.

As shown in Example Data No.1 through 5, the performance of transformers made using a molding resin containing 30–55 wt. % of an inorganic filler was found to be satisfactory initially, and gave heat cycle life of 300 cycles meeting the first target.

However, as shown in Comparative Example Data No. 6, if the content of the inorganic filler exceeded 60 wt. % the molding resin became too viscous to be injected thoroughly into the transformer.

EXAMPLE 2

The Table 2 shows the effect of various inorganic fillers used in bobbin materials.

Comparative Example Data No.7 shows the performance of the transformer made of PPS without any inorganic filler contained in the molding composition. Without inorganic filler in the bobbin, thermal stress occurred between the bobbin and the molded resin resulting in cracking of the molded resin.

As in Comparative Example Data No.8 if PPS resin composition containing only 10 wt. % of an inorganic filler the molding resin did not crack in the initial stage, but could withstand heat cycles of only 10 cycles.

TABLE 1

| | | Example | | | | | | |
|---|---|---|---|---|---|---|---|---|
| | | Comparative Example Data No. | | | | | Example Data No. | |
| Category | Item | 1 | 2 | 3 | 4 | 5 | 1 | 2 |
| Casting resin | Resin (Wt. %) | Epoxy 70 | Epoxy 70 | Epoxy 70 | Epoxy 90 | Epoxy 80 | Epoxy 70 | Epoxy 60 |
| | Inorganic filler (Wt. %) | Silica 30 | Silica 30 | Silica 30 | Silica 10 | Silica 20 | Silica 30 | Silica 40 |
| | Heat distortion temperature (° C.) | 100 | 120 | 150 | 150 | 150 | 150 | 150 |
| | Final curing condition (° C./h) | 115/3 | 120/3 | 150/3 | 150/3 | 150/3 | 150/3 | 150/3 |
| Bobbin | Resin (Wt. %) | PPO Composition 80 | PPO Composition 80 | PPO Composition 80 | PPS 40 | PPS 40 | PPS 40 | PPS 40 |
| | Inorganic filler (Wt. %) | Glass fiber 20 | Glass fiber 20 | Glass fiber 20 | Glass fiber 30 Talc 30 | Glass fiber 30 Talc 30 | Glass fiber 30 Talc 30 | Glass fiber 30 Talc 30 |
| | Heat distortion temperature (° C.) | 130 | 130 | 130 | 270 | 270 | 270 | 270 |
| Performance of Transformer | Initial state | Good | Bobbin deformation | Bobbin deformation | Cast resin cracked | Good | Good | Good |
| | Heat cycle life (cycle) | 1 | — | — | — | 50 | >300 | >300 |

| | | Example | | | |
|---|---|---|---|---|---|
| | | Example Data No. | | | Comparative Example Data No. |
| Category | Item | 3 | 4 | 5 | 6 |
| Casting resin | Resin (Wt. %) | Epoxy 60 | Epoxy 60 | Epoxy 45 | Epoxy 40 |
| | Inorganic filler (Wt. %) | Silica 20 Silica glass 20 | Silica glass 40 | Silica 55 | Silica 60 |
| | Heat distortion temperature (° C.) | 150 | 150 | 150 | 150 |
| | Final curing condition (° C./h) | 150/3 | 150/3 | 150/3 | 150/3 |
| Bobbin | Resin (Wt. %) | PPS 40 | PPS 40 | PPS 40 | PPS 40 |
| | Inorganic filler (Wt. %) | Glass fiber 30 Talc 30 | Glass fiber 30 Talc 30 | Glass fiber 30 Talc 30 | Glass fiber 30 Talc 30 |
| | Heat distortion temperature (° C.) | 270 | 270 | 270 | 270 |
| Performance of Transformer | Initial state | Good | Good | Good | Cast resin Poor fluidity |
| | Heat cycle life (cycle) | >300 | >300 | >300 | — |

When the content of the inorganic filler in PPS was in the range of 25–70 wt. % as shown in Example Data No. 6 through No. 11, all the Examples showed heat cycles of more than 300 cycles as well as a satisfactory initial performance.

The inorganic filler content exceeding 75 wt. % gave poor moldability and found to be inadequate for molding.

Those bobbins containing only 20 wt. % of inorganic filler gave inferior results in heat cycle life test as shown in Comparative Example Data No. 11–No. 14. On the other hand, those bobbins containing approximately 50 wt. % of inorganic fillers gave more than 300 cycles in heat cycle test as shown in the Example Data No. 12–No. 15.

TABLE 2

| | | Example | | | | |
|---|---|---|---|---|---|---|
| | | Comparative Example Data No. | | Example Data No. | | |
| Category | Item | 7 | 8 | 6 | 7 | 8 |
| Casting resin | Resin (Wt. %) | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass |
| | Heat distortion temperature (° C.) | 150 | 150 | 150 | 150 | 150 |
| | Final curing condition (° C./h) | 150/3 | 150/3 | 150/3 | 150/3 | 150/3 |
| Bobbin | Resin (Wt. %) | PPS 100 | PPS 80 | PPS 75 | PPS 70 | PPS 50 |
| | Inorganic filler (Wt. %) | 0 | Glass fiber 20 | Glass fiber 25 | Glass fiber 30 | Glass fiber 50 |
| | Heat distortion temperature (° C.) | 108 | 260 | 270 | 270 | 270 |
| Performance of Transformer | Initial state | Cast resin cracked | Good | Good | Good | Good |
| | Heat cycle life (cycle) | — | 10 | 300 | >300 | >300 |

| | | Example | | | | |
|---|---|---|---|---|---|---|
| | | Example Data No. | | | Comparative Example Data No. | |
| Category | Item | 9 | 10 | 11 | 9 | 10 |
| Casting resin | Resin (Wt. %) | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 150 | 150 | 150 | 150 | 150 |
| | Final curing condition (° C./h) | 150/3 | 150/3 | 150/3 | 150/3 | 150/3 |
| Bobbin | Resin (Wt. %) | PPS 50 | PPS 40 | PPS 30 | PPS 25 | PPS 25 |
| | Inorganic filler (Wt. %) | Glass fiber 30 Talc 20 | Glass fiber 30 Talc 30 | Glass fiber 30 Talc 40 | Glass fiber 30 Talc 45 | Glass fiber 75 |
| | Heat distortion temperature (° C.) | 270 | 270 | 270 | 270 | 270 |
| Performance of Transformer | Initial state | Good | Good | Good | Bobbin poor moldability | Bobbin poor moldability |
| | Heat cycle life (cycle) | >300 | >300 | >300 | — | — |

EXAMPLE 3

Table 3 shows the effect of resin composition of the bobbin material and the effect of surface treatment on the performance of transformers.

Heat resistant polymeric materials having heat distortion temperature of 130° C. or above such as, polyether sulfone (PES), polyether imide (PEI, called Ultem which is the commercial name of a product from GE Corporation), Polyether-ether ketone (PEEK), liquid crystalline aromatic polyester (generally known as "Liquid crystal polymer", for example, Vectra, Trademark of Polyplastic Co.) were used.

In the Example Data No. 16–19, the effect of alumina blast treatment on the performance of transformers is shown. Alumina powder having a particle size of approximately 0.1 mm was blown against the surface of the bobbins at the pressure of 0.4 MP a. After the blasting treatment was made the surface of the bobbin was found to be scraped off in 0.05 mm depth and have unevenness of 0.01 mm. As is evident from these data alumina blasting treatment was found to be quite effective to give more than 500 cycles in the heat cycle test.

TABLE 3

| | | Example | | | | | |
|---|---|---|---|---|---|---|---|
| | | Comparative Example Date No. | | | | Example Data No. | |
| Category | Item | 11 | 12 | 13 | 14 | 12 | 13 |
| Casting resin | Resin (Wt. %) | Epoxy 60 | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 155 | 155 | 155 | 155 | 155 | 155 |
| | Final curing condition (° C./h) | 155/3 | 155/3 | 155/3 | 155/3 | 155/3 | 155/3 |
| Bobbin | Resin (Wt. %) | PES 80 | PEI 80 | PEEK 80 | LCpolymer 80 | PES 50 | PEI 50 |
| | Inorganic filler (Wt. %) | Glass fiber 20 | Glass fiber 20 | Glass fiber 20 | Glass fiber 20 | Glass fiber 30 Talc 20 | Glass fiber 30 Talc 20 |
| | Heat distortion temperature (° C.) | 207 | 210 | 300 | 280 | 207 | 210 |
| | Surface treatment | — | — | — | — | — | — |
| Performance of Transformer | Initial state | Good | Good | Good | Good | Good | Good |
| | Heat cycle life (cycle) | 5 | 10 | 3 | 3 | >300 | >300 |

| | | Example | | | | | |
|---|---|---|---|---|---|---|---|
| | | Example Data No. | | | | | |
| Category | Item | 14 | 15 | 16 | 17 | 18 | 19 |
| Casting resin | Resin (Wt. %) | Epoxy 60 | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 155 | 155 | 155 | 155 | 155 | 155 |
| | Final curing condition (° C./h) | 155/3 | 155/3 | 155/3 | 155/3 | 155/3 | 155/3 |
| Bobbin | Resin (Wt. %) | PEEK 50 | LCpolymer 50 | PES 50 | PEI 50 | PEEK 50 | LCpolymer 50 |
| | Inorganic filler (Wt. %) | Glass fiber 30 Talc 20 | Glass fiber 30 Talc 20 | Glass fiber 30 Talc 20 | Glass fiber 30 Talc 20 | Glass fiber 30 Talc 20 | Glass fiber 30 Talc 20 |
| | Heat distortion temperature (° C.) | 300 | 280 | 207 | 210 | 300 | 280 |
| | Surface treatment | — | — | Blast Alumina | Blast Alumina | Blast Alumina | Blast Alumina |
| Performance of Transformer | Initial state | Good | Good | Good | Good | Good | Good |
| | Heat cycle life (cycle) | >300 | >300 | >500 | >500 | >500 | >500 |

EXAMPLE 4

Table 4 shows the effect of various surface treatments on the bobbins made of PPS.

Powders used in the blasting treatments are, glass beads having a diameter of approximately 0.1 mm, Nylon powder having a diameter of approximately 0.4 mm, and alumina powder having a diameter of approximately 0.1 mm. These powders were blasted at the pressure of 0.2 Mpa against the surface of the bobbins made of PPS resin compositions containing inorganic fillers. Depending upon the type of powder used, the surface showed different reflection characteristics. After the blast treatment, the surface of bobbins were observed through a microscope to confirm that the blast treatment indeed gave scraped surfaces on the all the samples tested.

As is evident from the data shown in the Example Data No. 20–23, and No.27, those bobbins received the blasting treatment showed tendency of an extended heat cycle life.

Coating treatment on the bobbin surface was made in the following manner. A solid epoxy resin of bis-phenol A type was dissolved in methylethyl ketone to give a 5 wt. % coating solution. A molded bobbin was immersed into the coating solution for 5 sec. After removed from the solution, the bobbin was dried. Performance of the transformers made with epoxy coated bobbins is shown in the Example Data No. 24, 23, and 28. It is evident from these data that the epoxy coating treatment is quite effective in extending heat cycles.

As the Example Data No.26 and 29 shows, a combination of blasting treatment and epoxy coating treatment also gave increased heat cycles.

TABLE 4

| | | Example | | | | |
|---|---|---|---|---|---|---|
| | | Example Data No. | | | | |
| Category | Item | 20 | 21 | 22 | 23 | 24 |
| Casting resin | Resin (Wt. %) | Epoxy 60 | Epoxy 60 | Epoxy 60 | Epoxy 60 | Epoxy 60 |
| | Inorganic filler (Wt. %) | Silica 20 Silica glass 20 | Silica 20 Silcia glass 20 | Silica 20 Silica glass 20 | Silica 20 Silica glass 20 | Silica 20 Silica glass 20 |
| | Heat distortion temperature (° C.) | 145 | 145 | 145 | 145 | 145 |
| | Final curing condition (° C./h) | 150/3 | 150/3 | 150/3 | 150/3 | 150/3 |
| Bobbin | Resin (Wt. %) | PPS 75 | PPS 75 | PPS 75 | PPS 75 | PPS 75 |
| | Inorganic filler (Wt. %) | Glass fiber 25 | Glass fiber 25 | Glass fiber 25 | Glass fiber 25 | Glass fiber 25 |
| | Heat distortion temperature (° C.) | 270 | 270 | 270 | 270 | 270 |
| | Surface treatment | — | Blast Glass beads | Blast Nylon | Blast Alumina | Epoxy coating Eq.:900 |
| Performance of Transformer | Initial state | Good | Good | Good | Good | Good |
| | Heat cycle life (cycle) | 300 | 450 | 400 | >500 | >500 |

| | | Example | | | | |
|---|---|---|---|---|---|---|
| | | Example Data No. | | | | |
| Category | Item | 25 | 26 | 27 | 28 | 29 |
| Casting resin | Resin (Wt. %) | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 145 | 145 | 145 | 145 | 145 |
| | Final curing condition (° C./h) | 150/3 | 150/3 | 150/3 | 150/3 | 150/3 |
| Bobbin | Resin (Wt. %) | PPS 75 | PPS 75 | PPS 40 | PPS 40 | PPS 40 |
| | Inorganic filler (Wt. %) | Glass fiber 25 | Glass fiber 25 | Glass fiber 30 Talc 30 | Glass fiber 30 Talc 30 | Glass fiber 30 Talc 30 |
| | Heat distortion temperature (° C.) | 270 | 270 | 270 | 270 | 270 |
| | Surface treatment | Epoxy coating Eq.:2000 | Blast Alumina + Epoxy coating Eq.:900 | Blast Alumina | Epoxy coating Eq.:900 | Blast Alumina + Epoxy coating Eq.:900 |
| Performance of Transformer | Initial state | Good | Good | Good | Good | Good |
| | Heat cycle life (cycle) | >500 | >500 | >500 | >500 | >500 |

EXAMPLE 5

Table 5 shows the effect of epoxy coating treatment made on the surface of bobbins made of PES and PEI. N-methyl-2-pyrrolidone, which can partially dissolve PES and PEI was used as a solvent to make 3 wt. % epoxy resin solution. Bobbins molded from PES and PEI were immersed into the coating solution for 2 sec. After removed from the solution they were quickly dried to give coated bobbins. It was observed that the epoxy resin and the bobbin material formed a mixed layer on the surface of the bobbins.

In the Comparative Example Data No. 15, as the bobbin did not contain any inorganic filler thermal stress occurred between the bobbin and molded resin resulting in cracking in the molded resin. In the Comparative Example Data No. 16 and 18, although the initial performance were satisfactory owing to the inorganic filler in the bobbins, poor results were obtained in heat cycle test. When bobbins were precoated with the epoxy resin as seen in the Example Data No.30–32, and No. 33–35, remarkable improvement in heat cycle test was observed.

When PEEK and liquid crystal polymer were used in the bobbin compositions, a similar improvement in heat cycle test was obtained when bobbins were precoated with epoxy as shown in the Example Data No.36 and 37.

TABLE 5

| | | Example | | | | | |
|---|---|---|---|---|---|---|---|
| | | Comparative Example Data No. | | | Example Data No. | | |
| Category | Item | 15 | 16 | 17 | 30 | 31 | 32 |
| Casting resin | Resin (Wt. %) | Epoxy 60 | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 150 | 150 | 150 | 150 | 150 | 150 |
| | Final curing condition (° C./h) | 150/3 | 150/3 | 150/3 | 150/3 | 150/3 | 150/3 |
| Bobbin | Resin (Wt. %) | PES 100 | PES 90 | PES 80 | PES 90 | PES 80 | PES 70 |
| | Inorganic filler (Wt. %) | 0 | Glass fiber 10 | Glass fiber 20 | Glass fiber 10 | Glass fiber 20 | Glass fiber 30 |
| | Heat distortion temperature (° C.) | 207 | 207 | 207 | 207 | 207 | 207 |
| | Surface treatment | — | — | — | Epoxy coating Eq.:900 | Epoxy coating Eq.:900 | Epoxy coating Eq.:900 |
| Performance of Transformer | Initial state | Cast resin cracked | Good | Good | Good | Good | Good |
| | Heat cycle life (cycle) | — | 1 | 50 | 300 | >500 | >500 |

| | | Example | | | | | |
|---|---|---|---|---|---|---|---|
| | | Comparative Example Data No. | Example Data No. | | | | |
| Category | Item | 18 | 33 | 34 | 35 | 36 | 37 |
| Casting resin | Resin (Wt. %) | Epoxy 60 | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 150 | 150 | 150 | 150 | 150 | 150 |
| | Final curing condition (° C./h) | 150/3 | 150/3 | 150/3 | 150/3 | 150/3 | 150/3 |
| Bobbin | Resin (Wt. %) | PEI 90 | PEI 90 | PEI 80 | PEI 70 | PEEK 50 | LCpolymer 50 |
| | Inorganic filler (Wt. %) | Glass fiber 10 | Glass fiber 10 | Glass fiber 20 | Glass fiber 30 | Glass fiber 30 Talc 20 | Glass fiber 30 Talc 20 |
| | Heat distortion temperature (° C.) | 210 | 210 | 210 | 210 | 300 | 280 |
| | Surface treatment | — | Epoxy coating Eq.:2000 | Epoxy coating Eq.:2000 | Epoxy coating Eq.:2000 | Epoxy coating Eq.:900 | Epoxy coating Eq.:900 |
| Performance of Transformer | Initial state | Good | Good | Good | Good | Good | Good |
| | Heat cycle life (cycle) | 1 | 350 | >500 | >500 | >500 | >500 |

EXAMPLE 6

Figure 2:
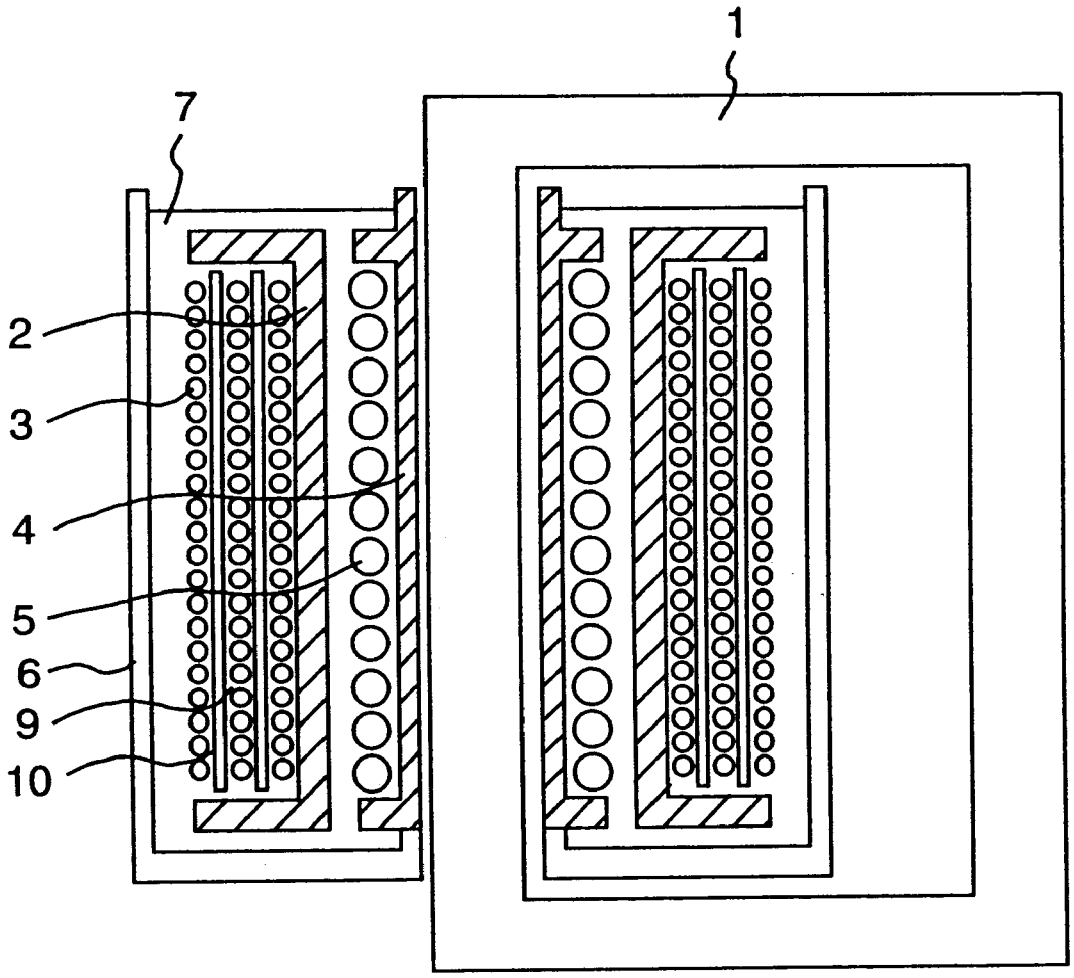
FIG. 2 is a schematic illustration of a flyback transformer for driving cathode ray tubes.

In this experiment a high voltage flyback transformer for driving cathode ray tubes as illustrated in FIG. 2 was used. This transformer had dimensions of 40 mm in diameter and 52 mm in length. The dimensions of primary and secondary coils were 17 mm and 30 mm in diameters, and 45 mm and 30 mm in lengths respectively. Primary and secondary bobbins were prepared by molding various molding compositions and wiring is performed on the bobbins.

A secondary coil (3) was wound on a secondary bobbin (2) using an interlayer polyimide film (10), and fitted around a primary bobbin (4) and a coil (5). The parts are housed in a case (6), and dried in an oven at 115° C. to remove any moisture present. Under vacuum, an epoxy casting resin composition (7) was poured into the case, and cured by raising temperature from the room temperature to the final temperature which was carefully controlled.

Inserting the magnetic core (1) into the center of the primary bobbin (4) completed the constitution of the flyback transformer.

The initial performance of the transformer was checked from the appearance and rated operations. Heat cycle test was also performed on these transformers. After each cycle (−40° C./1 h and 130° C./1 h), the transformer was checked to see if any dielectric breakdown had occurred. Table 6 shows the result of heat cycle life test in which the life of the transformer is considered equal to the cycle at which the transformer showed dielectric breakdown.

The result obtained for transformers for cathode ray tubes are found to be similar to those results obtained for automotive transformers shown in EXAMPLE 1–5.

Adhesive strength was measured by lifting the rod vertically while the plastic sheet was fixed. The result is shown in Table 7.

When PPO composition was used for the plastic sheet, cohesive failure was observed and the high adhesive strength of more than 20 MP a was observed as shown in Comparative Example Data No. 23 and 24. However, the PPO composition has a weakness in heat distortion temperature. To overcome this problem, heat resistant PPS was tried, but gave a poor adhesion showing interface failure as shown in Comparative Data No.25.

All the materials related to this invention shown in Example Data No. 47–54 shows excellent heat resistance and adhesion.

TABLE 6

| | | Example | | | | | | |
|---|---|---|---|---|---|---|---|---|
| | | Comparative Example Data No. | | Example Data No. | | | | |
| Category | Item | 19 | 20 | 38 | 39 | 40 | 41 | 42 |
| Casting resin | Resin (Wt. %) | Epoxy 60 | Epoxy 60 | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 150 | 150 | 150 | 150 | 150 | 150 | 150 |
| | Final curing condition (° C./h) | 150/3 | 150/3 | 150/3 | 150/3 | 150/3 | 150/3 | 150/3 |
| Bobbin | Resin (Wt. %) | PPS 100 | PPS 80 | PPS 70 | PPS 50 | PPS 40 | PPS 40 | PES 40 |
| | Inorganic filler (Wt. %) | 0 | Glass fiber 20 | Glass fiber 30 | Glass fiber 50 | Glass fiber 30 Talc 30 | Glass fiber 30 Talc 30 | Glass fiber 30 Talc 30 |
| | Heat distortion temperature (° C.) | 108 | 260 | 270 | 270 | 270 | 270 | 270 |
| | Surface treatment | — | — | — | — | — | Blast Alumina | Epoxy coating Eq.:900 |
| Performance of Transformer | Initial state | Cast resin cracked | Good | Good | Good | Good | Good | Good |
| | Heat cycle life (cycle) | — | 1 | 350 | >500 | >500 | >500 | >500 |

| | | Example | | | | | |
|---|---|---|---|---|---|---|---|
| | | Comparative Example Data No. | Example Data No. | | Comparative Example Data No. | Example Data No. | |
| Category | Item | 21 | 43 | 44 | 22 | 45 | 46 |
| Casting resin | Resin (Wt. %) | Epoxy 60 | Epoxy 60 | Epoxy 60 | Epoxy 60 | Epoxy 60 | Epoxy 60 |
| | Inorganic filler (Wt. %) | Silica 20 Silica glass 20 | Silica 20 Silica glass 20 | Silica 20 Silica glass 20 | Silica 20 Silica glass 20 | Silica 20 Silica glass 20 | Silica 20 Silica glass 20 |
| | Heat distortion temperature (° C.) | 150 | 150 | 150 | 150 | 150 | 150 |
| | Final curing condition (° C./h) | 150/3 | 150/3 | 150/3 | 150/3 | 150/3 | 150/3 |
| Bobbin | Resin (Wt. %) | PES 100 | PES 70 | PES 70 | PEI 100 | PEI 70 | PEI 70 |
| | Inorganic filler (Wt. %) | 0 | Glass fiber 30 | Glass fiber 30 | 0 | Glass fiber 30 | Glass fiber 30 |
| | Heat distortion temperature (° C.) | 207 | 207 | 207 | 210 | 210 | 210 |
| | Surface treatment | — | — | | — | — | Epoxy coating Eq.:900 |
| Performance of Transformer | Initial state | Cast resin cracked | Good | Good | Cast resin cracked | Good | Good |
| | Heat cycle life (cycle) | — | >500 | >500 | — | >500 | >500 |

EXAMPLE 7

Aluminum round rod having a diameter of 3.6 mm with a smooth section was vertically placed on a plastic sheet of 3 mm thickness made of the same material used to make bobbins. An adhesive epoxy resin was coated on the section of the rod and cured. The adhesive resin used herein was the same as that used in Example Data 3 in Table 1 in EXAMPLE 1.

TABLE 7

| | | Example | | | | | |
|---|---|---|---|---|---|---|---|
| | | Comparative Example Data No. | | | Example Data No. | | |
| Category | Item | 23 | 24 | 25 | 47 | 48 | 49 |
| Plastic | Resin (Wt. %) | PPO Composition 100 | PPO Compositon 80 | PPS 100 | PPS 70 | PPS 40 | PPS 40 |
| | Inorganic filler (Wt. %) | 0 | Glass fiber 20 | 0 | Glass fiber 30 | Glass fiber 30 Talc 30 | Glass fiber 30 Talc 30 |
| | Heat distortion temperature (° C.) | 130 | 130 | 270 | 270 | 270 | 270 |
| | Surface treatment | — | — | — | — | — | Blast Alumina |
| Adhesive strength | Mode of failure | Cohesive | Cohesive | Interface | Cohesive + Interface | Cohesive | Cohesive |
| | Adhesive strength (MPa) | 20 | 25 | 10 | 20 | 25 | 26 |

| | | | Example | | | | |
|---|---|---|---|---|---|---|---|
| | | | Example Data No. | | | | |
| | Category | Item | 50 | 51 | 52 | 53 | 54 |
| | Plastic | Resin (Wt. %) | PPS 40 | PES 70 | PES 70 | PEI 70 | PEI 70 |
| | | Inorganic filler (Wt. %) | Glass fiber 30 Talc 30 | Glass fiber 30 | Glass fiber 30 | Glass fiber 30 | Glass fiber 30 |
| | | Heat distortion temperature (° C.) | 270 | 207 | 207 | 210 | 210 |
| | | Surface treatment | Epoxy coating Eq.:900 | — | Epoxy coating Eq.:900 | — | Epoxy coating Eq.:900 |
| | Adhesive strength | Mode of failure | Cohesive | Cohesive + Interface | Cohesive | Cohesive + Interface | Cohesive |
| | | Adhesive strength (MPa) | 25 | 20 | 25 | 20 | 25 |

EXAMPLE 8

Figure 3:
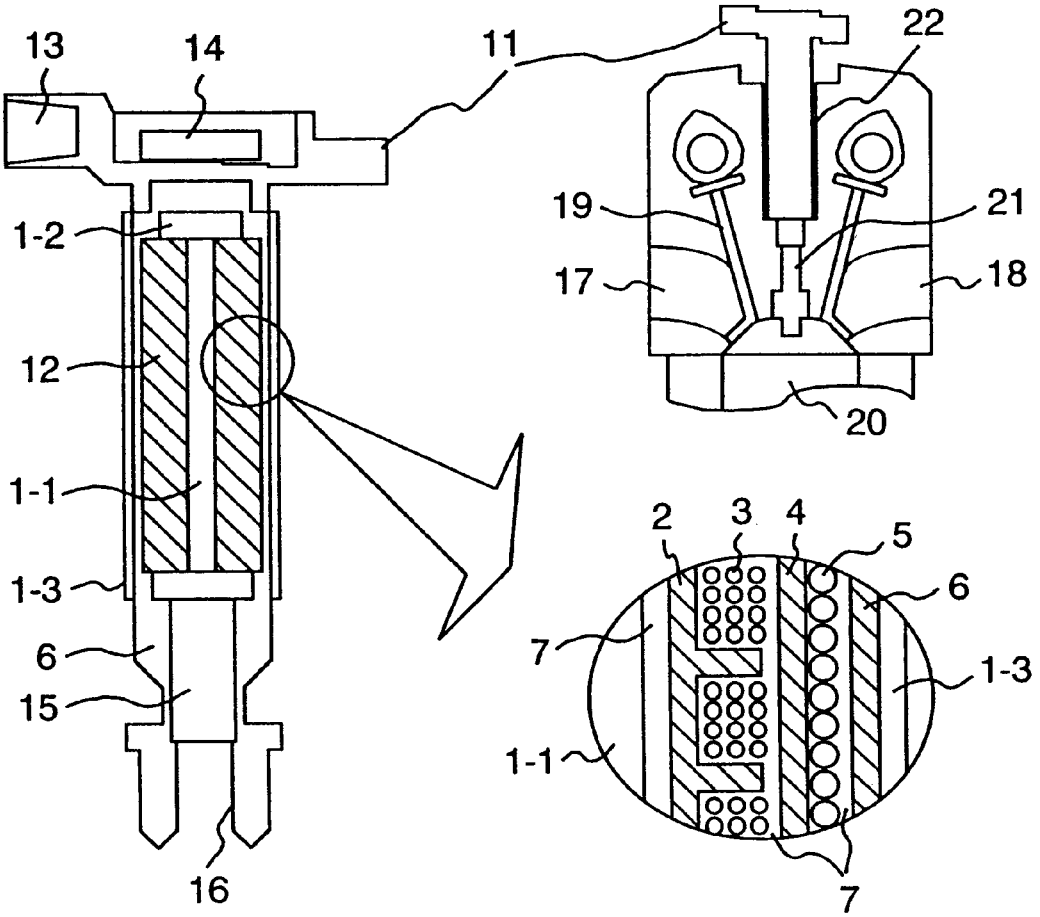
FIG. 3 is a schematic illustration of an automotive ignition transformer.

An automotive ignition transformer of a direct ignition type 11 as shown in FIG. 3 was made by using a casting resin and a bobbin shown in Example Data No. 3 in Table 1. The ignition transformer 11 was 22 mm in diameter, and 130 mm in length, and constituted of an interior magnetic core 1-1, 1-2, an exterior core 1-3, and a coil part 12 comprising a secondary bobbin 2 and a coil 3, a primary bobbin 4 and a coil 5, a case 6, and an epoxy casting resin 7. Signals entered into an input terminal 13 go through control circuit 14, and are converted to a higher voltage of approximately 15 kV peak voltage in the coil part 12. The output comes out from an output terminal 16 through rectifier 15. The ignition transformer 11, placed in engine in plug hall 22 is connected to ignition plug 21 attached to combustion cylinder 20 with other parts, such as an inlet port 17, an exhaust port 18, and control valve 19.

The ignition transformers made as described above were found to function normally for more than 1000 hours in a continuous operation at 150° C.

As described above, it is now possible with this invention to provide at a low cost a small sized high voltage transformer which is highly reliable and heat resistant.

What is claimed is:

1. A high voltage transformer which provides an output voltage of 10–35 kV comprising a magnetic core, a primary coil bobbin having a primary coil wound thereon, a secondary coil bobbin having a secondary coil wound thereon, and an injectable and curable casting resin injected into at least a region surrounding said primary coil and said secondary coil, wherein at least one of the surface of said primary coil bobbin and said secondary coil bobbin is pretreated so as to enhance adhesiveness between said casting resin and at least one of said primary coil bobbin and said secondary coil bobbin.

2. A high voltage transformer according to claim 1, wherein an inorganic filler contained in said casting resin is selected from the group consisting of silica, silica glass, and a mixture of silica and silica glass.

3. A high voltage transformer according to claim 1, wherein an inorganic filler contained in said at least one of said primary coil bobbin and said secondary coil bobbin is selected from the group consisting of glass fiber, talc and a mixture of talc and glass fiber.

4. A high voltage transformer according to claim 1, wherein said pretreated surface is a sandblasted surface.

5. A high voltage transformer according to claim 1, wherein said pretreated surface is precoated with a dissolved epoxy resin.

6. A high voltage transformer according to claim 1, wherein said primary coil bobbin is arranged outside of said secondary coil bobbin.

7. A high voltage transformer according to claim 6, wherein an inorganic filler contained in said casting resin is selected from the group consisting of silica, silica glass, and a mixture of silica and silica glass.

8. A high voltage transformer according to claim 6, wherein an inorganic filler contained in at least one of said primary coil bobbin and said secondary coil bobbin is selected from the group consisting of glass fiber, talc and a mixture of talc and glass fiber.

9. A high voltage transformer according to claim 6, wherein said pretreated surface is a sandblasted surface.

10. A high voltage transformer according to claim 6, wherein said pretreated surface is precoated with a dissolved epoxy resin.

11. A high voltage transformer according to claim 6, wherein said casting resin has a heat distortion temperature of at least 130° C., and is an epoxy resin containing 30–55 wt. % of an inorganic filler; and wherein at least one of said primary coil bobbin and said secondary coil bobbin has a heat distortion temperature of at least 130° C., and contains 25–75 wt. % of an inorganic filler and a resin selected from the group consisting of polyphenylene sulfide, polyether sulfone, polyether imide, polyether ketone, and liquid crystal polymer.

12. A high voltage transformer according to claim 11, wherein said inorganic filler contained in said epoxy resin is selected from the group consisting of silica, silica glass, and a mixture of silica and silica glass.

13. A high voltage transformer according to claim 11, wherein said inorganic filler contained in said at least one of said primary coil bobbin and said secondary coil bobbin is selected from the group consisting of glass fiber, talc and a mixture of talc and glass fiber.

14. A high voltage transformer according to claim 11, wherein said pretreated surface is a sandblasted surface.

15. A high voltage transformer according to claim 11, wherein said pretreated surface is precoated with a dissolved epoxy resin.

16. An ignition transformer using a high voltage transformer which provides an output voltage of 10–35 kV comprising a magnetic core, a primary coil bobbin having a primary coil wound thereon, a secondary coil bobbin having a secondary coil wound thereon, and an injectable and curable casting resin injected into at least a region surrounding said primary coil and said secondary coil, wherein at least one of the surface of said primary coil bobbin and said secondary coil bobbin is pretreated so as to enhance adhesiveness between said casting resin and at least one of said primary coil bobbin and said secondary coil bobbin.

17. An ignition transformer according to claim 16, wherein an inorganic filler contained in said casting resin is selected from the group consisting of silica, silica glass, and a mixture of silica and silica glass.

18. An ignition transformer according to claim 16, wherein an inorganic filler contained in said at least one of said primary coil bobbin and said secondary coil bobbin is selected from the group consisting of glass fiber, talc and a mixture of talc and glass fiber.

19. An ignition transformer according to claim 16, wherein said pretreated surface is a sandblasted surface.

20. An ignition transformer according to claim 16, wherein said pretreated surface is precoated with a dissolved epoxy resin.

21. An ignition transformer according to claim 16, wherein said primary coil bobbin is arranged outside of said secondary coil bobbin.

22. An ignition transformer according to claim 21, wherein an inorganic filler contained in said casting resin is selected from the group consisting of silica, silica glass, and a mixture of silica and silica glass.

23. An ignition transformer according to claim 21, wherein an inorganic filler contained in said at least one of said primary coil bobbin and said secondary coil bobbin is selected from the group consisting of glass fiber, talc and a mixture of talc and glass fiber.

24. A high voltage transformer according to claim 21, wherein said pretreated surface is a sandblasted surface.

25. A high voltage transformer according to claim 21, wherein said pretreated surface is precoated with a dissolved epoxy resin.

26. An ignition transformer according to claim 21, wherein said casting resin has a heat distortion temperature of at least 130° C., and is an epoxy resin containing 30–55 wt. % of an inorganic filler, and wherein at least one of said primary coil bobbin and said secondary coil bobbin has a heat distortion temperature of at least 130° C., and contains 25–70 wt. % of an inorganic filler and a resin selected from the group consisting of polyphenylene sulfide polyether sulfone, polyether imide, polyether ketone, and liquid crystal polymer.

27. An ignition transformer according to claim 26, wherein an inorganic filler contained in said casting resin is selected from the group consisting of silica, silica glass, and a mixture of silica and silica glass.

28. An ignition transformer according to claim 26, wherein an inorganic filler contained in said at least one of said primary coil bobbin and said secondary coil bobbin is selected from the group consisting of glass fiber, talc and a mixture of talc and glass fiber.

29. A high voltage transformer according to claim 26, wherein said pretreated surface is a sandblasted surface.

30. A high voltage transformer according to claim 26, wherein said pretreated surface is precoated with a dissolved epoxy resin.

* * * * *